United States Patent [19]

Cunningham et al.

[11] 4,057,473

[45] Nov. 8, 1977

[54] METHOD OF REDUCING CELL LIQUOR HEADER CORROSION

[75] Inventors: Hugh Cunningham; Carl W. Raetzsch, both of Corpus Christi, Tex.

[73] Assignee: PPG Industries, Inc., Pittsburgh, Pa.

[21] Appl. No.: 667,052

[22] Filed: Mar. 15, 1976

[51] Int. Cl.[2] ..... C25B 1/16; C25B 1/26; C23F 13/00

[52] U.S. Cl. ..... 204/98; 204/128; 204/147; 204/196

[58] Field of Search ..... 204/196, 147, 98, 128

[56] References Cited

U.S. PATENT DOCUMENTS

| | | | |
|---|---|---|---|
| 2,890,157 | 6/1959 | Raetzsch | 204/196 |
| 3,208,925 | 9/1965 | Hutchison et al. | 204/196 |
| 3,347,768 | 10/1967 | Clark et al. | 204/196 |
| 3,755,108 | 8/1973 | Raetzsch et al. | 204/98 |
| 3,876,517 | 4/1975 | Raetzsch et al. | 204/196 |
| 3,972,796 | 8/1976 | Frohler et al. | 204/196 |

*Primary Examiner*—R. L. Andrews
*Attorney, Agent, or Firm*—Richard M. Goldman

[57] ABSTRACT

Disclosed is a method of conducting electrolysis where a reagent is fed to a plurality of individual electrolytic cells electrically in series, an electrical current is passed through the cells, and an electrically conductive effluent is recovered from each of the individual cells. The electrically conductive effluent is discharged from each of the individual cells through individual metal outlets corresponding to each cell and collected in a common trough. According to the disclosed method, the electrically conductive effluent in the trough is maintained anodic with respect to all of the metal outlets discharging into the trough.

6 Claims, 6 Drawing Figures

FIG. 4
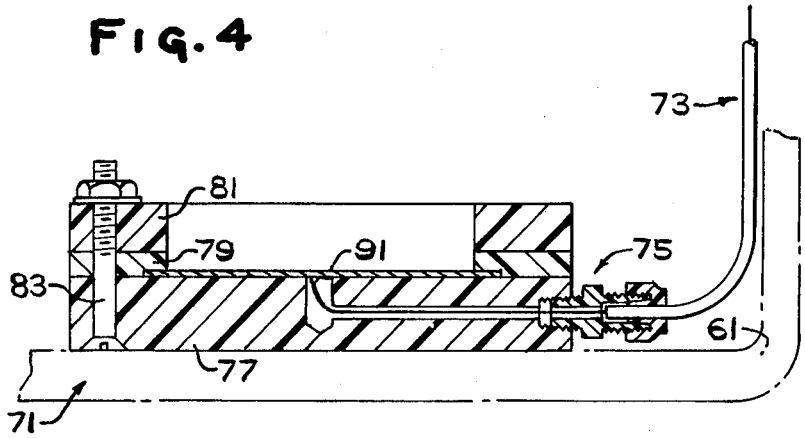
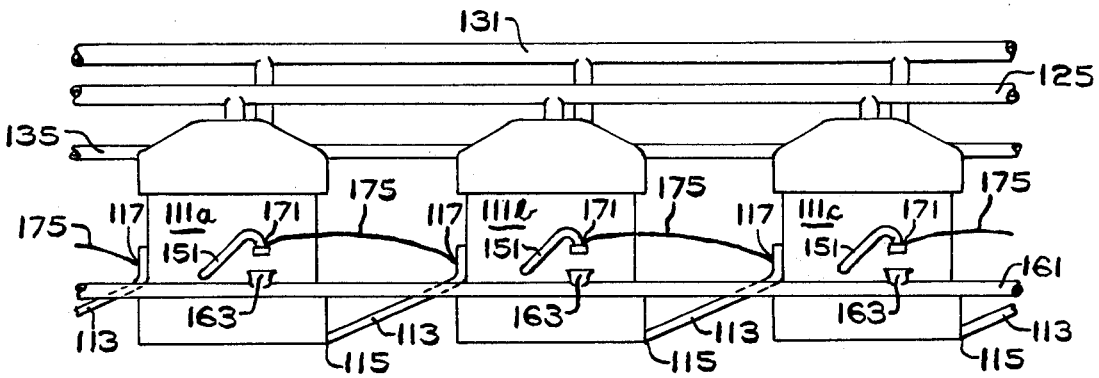
FIG. 5
FIG. 6
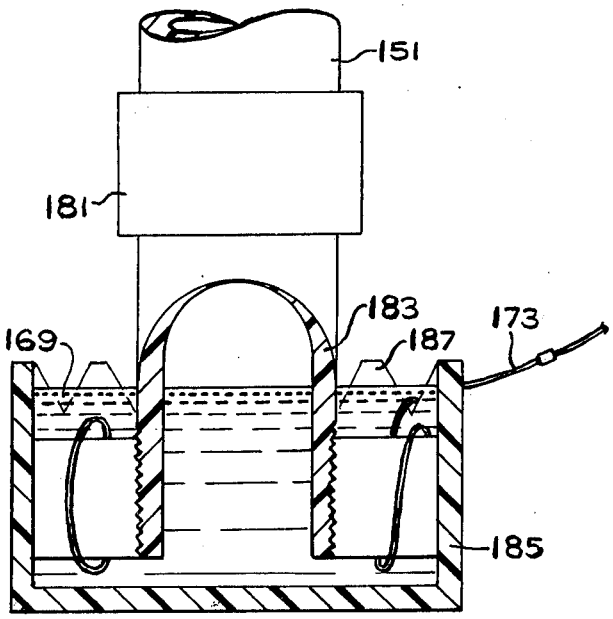

METHOD OF REDUCING CELL LIQUOR HEADER CORROSION

DESCRIPTION OF THE INVENTION

In electrolytic processes where the individual cells are electrically in series, for example, by the use of bus bars or bipolar electrolyzers, a potential exists across the group of cells. This may cause a problem where the cells have corrodible metal outlets for electrically conductive effluents from each individual cell and a common trough collecting the effluent from a plurality of individual cells. In a configuration of electrolytic cells in series with an electrically conductive effluent being collected in a common trough, a path exists for the passage of electrical current from the common trough to the cell outlet. This is true both in an electrolyzer containing individual bipolar electrolytic cells in series in a single unit and in a cell circuit having a plurality of monopolar cells in series. The metal effluent outlets that are anodic with respect to the effluent in the troughs are subject to corrosion.

In the electrolysis of alkali metal chloride brine, such as sodium chloride brine or potassium chloride brine to yield hydrogen, chlorine, and the corresponding alkali metal hydroxide, in a diaphragm cell, such as is described in Sconce, Chlorine, Reinhold Publishing Co. When the brine is sodium chloride, the catholyte product is aqueous cell liquor which contains from 10 to 20 percent sodium chloride and 5 to 15 percent sodium hydroxide, and is at a temperature of from 70° to 115° C. When this cell liquor is discharged from a plurality of electrolytic cells in series through individual metal effluent outlets, i.e., metal perc pipes, the metal effluent outlets, i.e., the perc pipes, may be either anodic or cathodic with respect to the electrolyte in the trough. At the anodic end of the series of cells the perc pipes are anodic with respect to the liquor in the trough, while at the cathodic end of the series of cells leading into a common trough the perc pipes are cathodic with respect to the electrolyte in the trough. In the case of a bipolar electrolyzer, the perc pipes at the anodic end of the electrolyzer are subject to corrosion. In a monopolar cell circuit where the cell liquor effluent is typically dropped from the perc pipe through a funnel to a cell liquor header, corrosion of the steel perc pipes is a problem, especially in the positive half of the circuit.

It has now been found that if the electrolyte in the trough is rendered anodic with respect to the most anodic of the outlets, the corrosion of the metal outlets is substantially reduced.

THE FIGURES

The method of this invention may be understood by reference to the Figures.

FIG. 4 is a cutaway elevation of an alternative exemplification of an electrode inserted in the trough of an electrolytic cell circuit according to the method of this invention.

FIG. 5 is a monopolar cell series circuit with perc pipes and a cell liquor trough.

FIG. 6 is a partial cutaway view of a perc pipe and an effluent cup useful in an alternative exemplification of this invention.

DETAILED DESCRIPTION OF THE INVENTION

Figure 1:
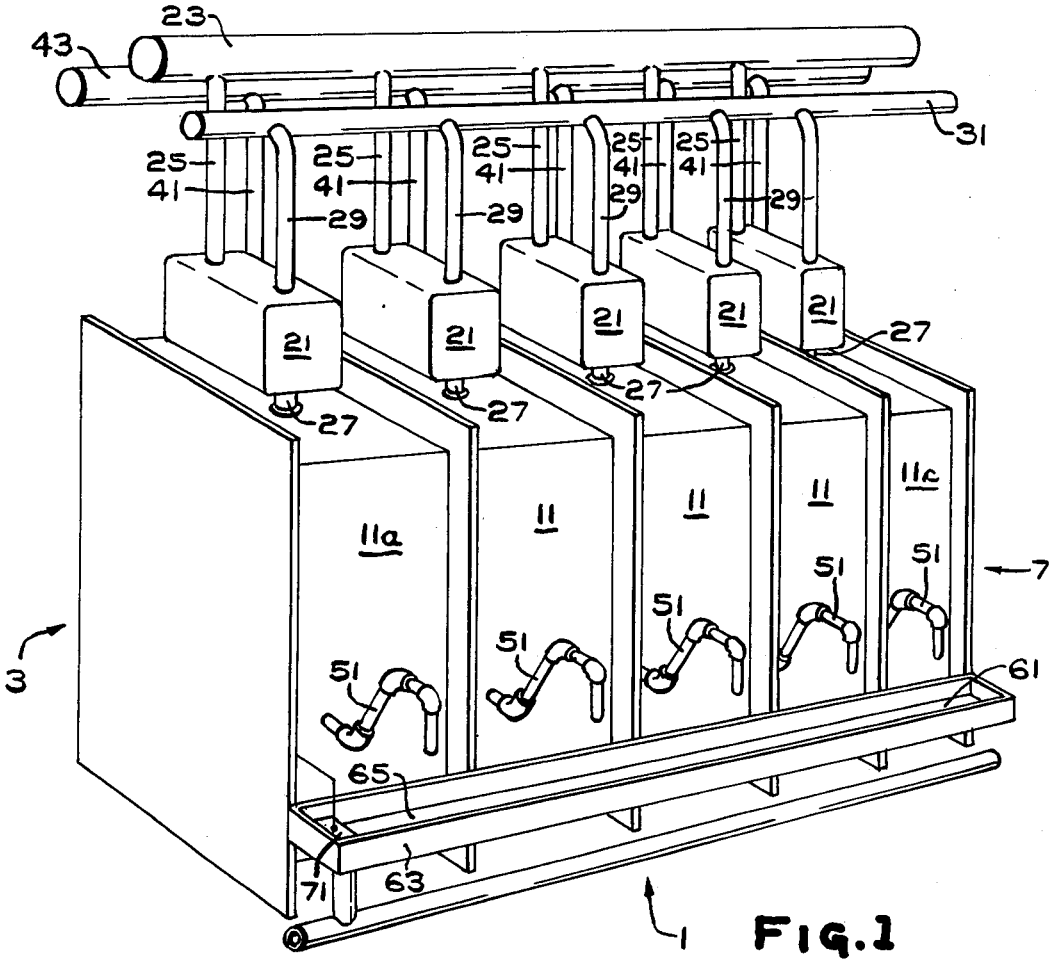
FIG. 1 shows a perspective view of a bipolar electrolyzer with perc pipes on the individual cells and a cell liquor trough.
Figure 2:
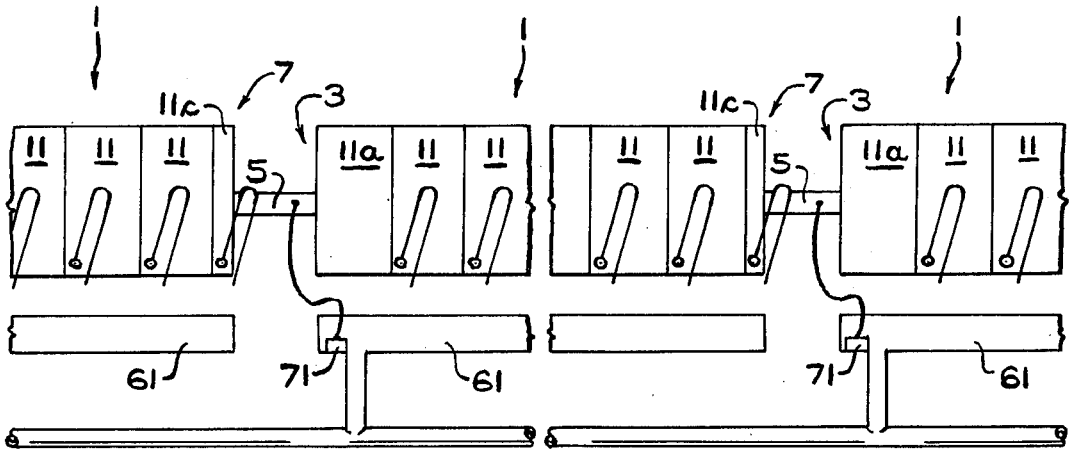
FIG. 2 is a schematic view of bipolar electrolyzer showing the portions of adjacent bipolar electrolyzers, perc pipes from the individual cells to the trough, and an electrical lead to the trough from the anodic end of the electrolyzer.

A bipolar electrolyzer 1 is shown in FIGS. 1 and 2. The bipolar electrolyzer 1 has a plurality of individual electrolytic cells 11 electrically and mechanically in series, with an anodic end cell 11*a* at one end of the electrolyzer 1 and a cathodic end cell 11*c* at the opposite end of the electrolyzer 1 and intermediate cells 11 between the anodic end cell 11*a* and the cathodic end cell 11*c* of the electrolyzer 1.

Atop the electrolyzer 1 are the brine tanks 21. Brine is fed from a brine header 23 through brine lines 25 to the brine tanks 21 and from the brine tanks 21 into the individual electrolytic cells 11. The brine tanks 21 also receive chlorine gas from the individual cells 11 through lines 27 to the brine tank 21 and discharge the chlorine from the brine tank 21 through chlorine lines 29 to a chlorine header 31.

Gaseous catholyte product is recovered from the individual cells 11 through hydrogen lines 41 to the hydrogen header 43. Liquid catholyte product is discharged from the cells 11 through the cell liquor perc pipes 51 to a trough 61. The cell liquor perc pipes 51 are metal effluent outlets from the catholyte chamber of the cells 11 and are adjustable to compensate for changes in diaphragm porosity over extended periods of electrolysis.

The trough 61 along side of the electrolyzer 1 collects catholyte liquor from the perc pipes 51 of all of the individual cells 11. It is normally open on top so as to allow for the adjustment of the perc pipes 51. In both monopolar cell circuits and bipolar cell circuits, it is advantageous to use non-conducting materials for the feed lines, gas headers, and cell liquor troughs. This reduces potential differences, e.g., between the perc pipe and the electrolyte in the trough.

As shown in FIGS. 1 and 2, an electrode 71 extends from the anodic end 3 of the electrolyzer 1 to the trough 61. The electrode leads may be from the outside of the anodic unit 11*a* as shown in FIG. 1 or from the bus bar 5 to the anodic end cell 11*a* as shown in FIG. 2, so as to maintain the electrode 71 electrically in parallel with the anodic end cell 11*a* of the electrolyzer 1.

Figure 3:
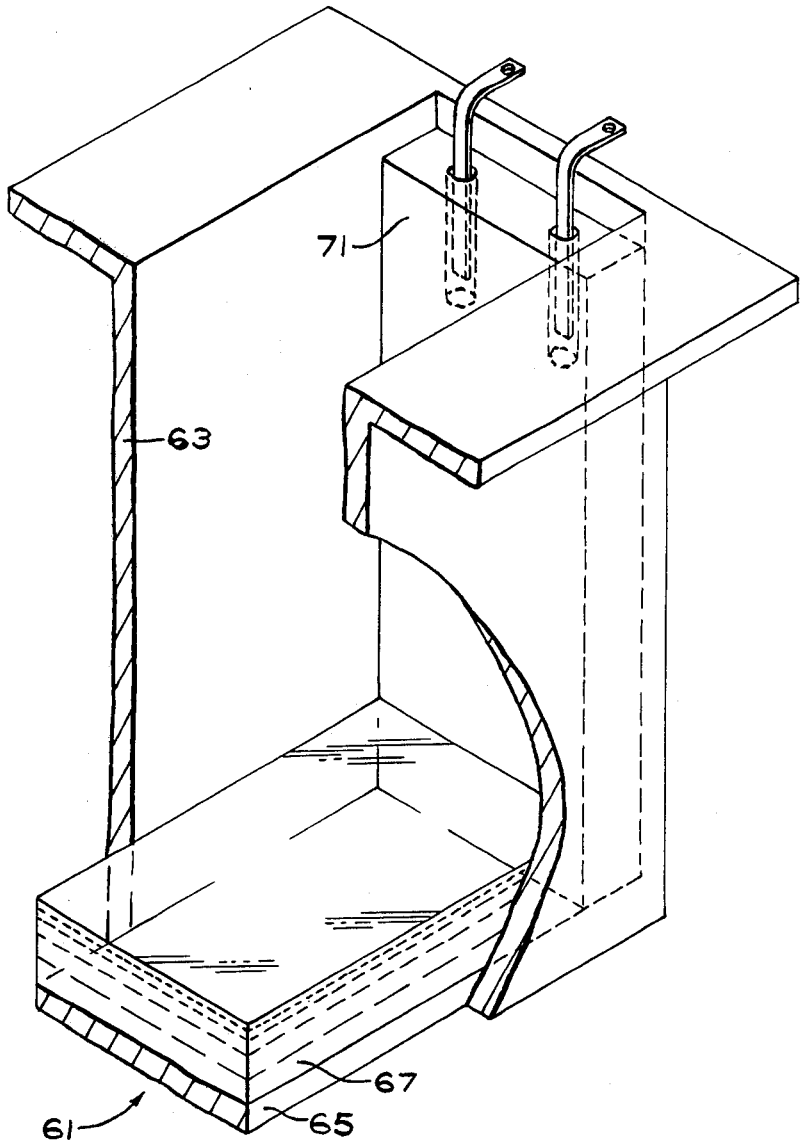
FIG. 3 is a partial cutaway view of the trough showing one exemplification of an electrode inserted in the trough and the current leads from the anodic end cell to the trough electrode.

The trough 61 and electrode 71 are shown in FIG. 3. The trough 61 has side walls 63, a bottom 65, and, in operation, a pool 67 of cell liquor therein. The electrode 71 may be a graphite block or plate, or a coated metal electrode, such as a platinum group metal-clad metal electrode, e.g., a platinum-clad titanium or tantalum electrode. Also contemplated herein is a lead dioxide coated electrode, for example, a lead dioxide coated graphite electrode or a lead dioxide coated titanium or tantalum electrode. Electrical leads connect the electrode 71 to the anode, or the anodic end unit 11*a,* or the bus bar 5 to the anodic end 3 of the bipolar electrolyzer 1. In this way, means are provided to maintain the trough 61 and the electrolyte effluent contained therein electrically in parallel with the anodic end cell 11*a* of the electrolyzer 1.

An alternative electrode is shown in partial cutaway in FIG. 4. The electrode 71, resting in the trough 61, has a caustic soda-resistant base 77, an electrolytically active surface 91, and a bearing member 81 bearing on said electrolytically active surface 91 through a gasket 79. Bolts 83 provide a compressive force on the bearing member 81.

A current lead 73 passes from the end cell or bus bar through liquid-tight fittings 75 to the underside of the electrolytically active surface 91.

The base 77 and the bearing member 81 may be fabricated of a caustic soda-resistant material such as polyvinyl chloride, polyvinylidene chloride, chlorinated polyvinyl chloride, polychlorotrifluoroethylene, polytetrafluoroethylene, polyvinylfluoride, polyvinylidene fluoride, or the like.

The electrolytically active surface may be provided by roll bonded platinized titanium, roll bonded platinized tantalum, or lead dioxide or conductive corrosion resistance material.

According to the method of this invention, a reagent is fed to individual cells electrically in series and discharging electrolyte effluent into a common trough. The reagent may be brine, for example, sodium chloride brine with a concentration of from about 275 grams per liter to about 325 grams per liter. An electrical current is passed through the electrolyzer to evolve product in each of the electrolytic cells. For example, where brine is electrolyzed and the product is chlorine, hydrogen, and the corresponding alkali metal hydroxide, a voltage of from about 3.0 to about 4.5 volts per cell is imposed across the electrolyzer so as to evolve chlorine at the anode, hydrogen at the cathode, and alkali metal hydroxide in the catholyte liquor. Thereafter, a catholyte product is recovered from the cell. In the electrolysis of alkali metal chlorides, the product is recovered through a metal perc pipe 51 and discharged from the perc pipe 51 into the trough 61 below the perc pipe 51 where it is collected. The effluent electrolyte, for example, catholyte cell liquor of sodium hydroxide, or sodium hydroxide-sodium chloride, or potassium hydroxide, or potassium hydroxide-potassium chloride, is an electrically conductive aqueous material. In this way, an electrolytic cell may be set up between the perc pipe 51 and the trough 61. In a bipolar electrolyzer 1 containing a plurality of cells 11 in series, for example, an eleven-cell electrolyzer, the perc pipes may be 12 or more volts cathodic with respect to the trough 61 at the cathodic end 7 of the electrolyzer 1 and 16 to 20 or more volts anodic with respect to the trough 61 at the anodic end 3 of the electrolyzer 1. The perc pipes 51 that are strongly anodic are subject to severe corrosion.

However, when an electrode 71 is inserted into the electrolyte effluent trough 61 electrically in parallel with or more anodic than the anodic end 3 of the electrolyzer 1, the perc pipe 51 at the anodic end 3 of the electrolyzer 1 becomes 3 to 4 volts cathodic with respect to the liquor in the trough 61, the perc pipe at the cathodic end 7 of the electrolyzer 1 may become 20 to 30 volts cathodic with respect to the liquor in the trough 61 and the intermediate perc pipe 51 are all at least 3 to 4 or more volts cathodic with respect to the liquor in the trough 61, thereby the corrosion of the perc pipes 51 is substantially suppressed.

According to the method of this invention, the amount of current required to maintain the trough and the liquor therein anodic with respect to the perc pipes is quite low, for example, on the order of from 2 to 10 amps in an eleven-cell electrolyzer operated at a current in excess of 60,000 amps.

According to the method of this invention, if sufficient current is caused to flow from an anodic end 3 of a bipolar electrolyzer 1 or an anodic end of a series of individual electrolytic cells electrically in series, discharging effluent into a common trough, the metal effluent outlets, e.g., the perc pipes 51, are cathodically protected and the corrosion of the perc pipes 51 is suppressed or even eliminated.

The method of this invention is also useful in preventing corrosion of the perc pipe in a series circuit of monopolar cells.

A monopolar cell series circuit is shown in FIG. 5. The circuit has a plurality of individual monopolar electrolytic diaphragm cells 111*a*, 111*b*, 111*c* electrically in series with bus bars 113 extending from the cathodic conductor 117 of one cell to the anodic conductor 115 of the next adjacent cell in the circuit.

Brine is fed to each cell 111 from brine header 125. Chlorine is collected in chlorine header 131 and hydrogen is collected in hydrogen header 135. The liquid catholyte product is discharged from the cells through cell liquor perc pipes 151 to cell liquor trough 161 through funnels 163. Typically, the cell liquor perc pipes 151 are metal effluent outlets from the catholyte chambers of the cells 111 and are adjustable to compensate for changes in diaphragm porosity over extended periods of electrolysis.

The trough 161 along the side of the individual cells 111*a*, 111*b*, 111*c* collects catholyte liquor from the individual perc pipes 151 of the individual cells 111. The wide mouths of the funnels 163 allow for adjustment of the individual perc pipes 151.

According to the method of this invention, as contemplated for monopolar cells, each individual perc pipe is connected to a point of higher potential. Thus, a perc pipe 151 may be electrically connected to the bus bar 117 leading from cathodes of a prior cell in the series circuit. Alternatively, the perc pipe 151 may be electrically connected to the perc pipe 151 of a prior cell in the series circuit.

Apparatus for carrying out one exemplification of the method of this invention with monopolar cells is shown in FIG. 6. As there shown, the metal perc pipe 151 has a plastic nipple 181 and plastic sleeve 183 thereon. The plastic sleeve opens into a plastic cup 185 attached to the end thereof. The plastic cup 185 is open at the top 187, e.g., with weirs or a serrated edge, to maintain a pool of electrolyte 169 while allowing the overflow thereof. An electrical wire 173 is inserted in the electrolyte 169 as an electrode and extends from the electrolyte in the cup 185 to a source of higher potential, e.g., the bus bar from the cathodes 117 of a prior cell in the circuit or the perc pipe 151 of a prior cell in the circuit. While these exemplifications are also useful with bipolar electrolyzers, the simpler exemplifications described previously are more advantageous.

The method of this invention may be more clearly understood by reference to the following Example.

EXAMPLE

An eleven-cell electrolyzer similar in construction to the electrolyzer described in U.S. Pat. No. 3,755,108 and operating at a current of 60,000 amperes had the perc pipe to cell liquid trough voltages shown in the left hand column of Table I prior to the use of an auxiliary electrode in the trough.

TABLE I

| Cell Number | Perc Pipe to Effluent Potential In an Eleven-Cell Electrolyzer: Without Trough Electrode (volts) | With Trough Electrode (volts) |
|---|---|---|
| 1 (cathodic end cell) | −11.9 to −12.1 | −23.5 to −24.0 |
| 2 | −8.6 to −8.9 | −21.5 to −22.0 |
| 3 | −5.9 to −6.1 | −17.0 to −18.0 |
| 4 | −3.3 to −3.5 | −15.5 to −16.0 |
| 5 | −2.5 to −2.7 | −14.5 to −15.0 |
| 6 | +0.8 to +1.0 | −10.0 to −11.5 |
| 7 | +4.8 to +5.0 | −14.1 to −14.3 |
| 8 | +6.8 to +7.0 | −10.8 to −10.9 |
| 9 | +10.3 to +10.5 | −9.6 to −9.8 |
| 10 | +13.1 to +13.5 | −6.25 to −6.30 |
| 11 (anodic end cell) | +17.4 to +17.7 | −3.75 to −3.85 |

Thereafter, a 13.6 inch by 6.25 inch by 1.25 inch graphite electrode was inserted in the trough, at the anodic end thereof, electrically in parallel with the anode of the anodic end unit of the bipolar electrolyzer. A section approximately 1.5 inch by 6.25 inch by 1.25 inch was submerged in the liquor. The perc pipe to cell liquor trough voltages shown in the right hand column of Table I were measured.

The current flowing through the auxiliary electrode was on the order of about 3.8 amps while the current flowing through the electrolyzer was on the order of about 60,000 amps.

While the invention has been described with reference to particular exemplifications and embodiments thereof, it is not intended to so limit the scope of the invention except insofar as to specific details recited in the appended claims.

We claim:

1. In a method of conducting electrolysis comprising feeding alkali metal chloride brine to a plurality of individual electrolytic cells electrically in series, passing electrical current through said cells, recovering electrolyte effluent from each of said individual cells through individual metal outlets, and collecting the electrolyte effluent from a plurality of said cells in a common trough vertically disposed beneath said individual metal outlets, the improvement which comprises maintaining an electrode in contact with the electrolyte effluent in said trough whereby to maintain said trough and said electrolyte anodic with respect to all of said metal outlets.

2. The method of claim 1 comprising maintaining said trough electrically in parallel with an anode in the most anodic electrolytic cell in the series of electrolytic cells emptying effluent into said trough.

3. The method of claim 2 wherein said individual electrolytic cells emptying effluent into a common trough are arrayed in the form of a bipolar electrolyzer and the electrode in contact with the electrolyte in said trough is electrically in parallel with an anodic end cell of said bipolar electrolyzer.

4. In a method of conducting electrolysis in a bipolar electrolyzer having a plurality of individual electrolytic cells mechanically and electrically in series, one of said cells being an anodic end cell, each of said cells having a metallic effluent outlet and a single trough vertically disposed beneath said metal effluent outlets, which method comprises the steps of feeding alkali metal chloride brine to each of said cells, passing an electrical current through said electrolyzer, withdrawing electrolyte effluent through said metal effluent outlets from each of said cells, and collecting said electrolyte effluent from said cell in the single trough, the improvement comprising maintaining an electrode in contact with the electrolyte effluent in said trough whereby to maintain said trough and said electrolyte anodic with respect to said electrolyzer.

5. The method of claim 4 comprising maintaining said trough electrically in parallel with said anodic end cell.

6. The method of claim 5 comprising inserting an electrode electrically in parallel with said anodic end cell in said trough.

* * * * *